United States Patent [19]

Lorenzen et al.

[11] Patent Number: 4,537,206

[45] Date of Patent: Aug. 27, 1985

[54] APPARATUS FOR PERFORATING AND TESTING THE PERMEABILITY OF RUNNING WEBS OF CIGARETTE PAPER OR THE LIKE

[75] Inventors: Heinz-Christen Lorenzen, Wentorf; Uwe Heitmann, Hamburg; Kurt-Eckart Petersen, Wentorf; Peter Pinck, Gross-Hansdorf, all of Fed. Rep. of Germany

[73] Assignee: Hauni-Werke Körber & Co. KG., Hamburg, Fed. Rep. of Germany

[21] Appl. No.: 424,487

[22] Filed: Sep. 27, 1982

[30] Foreign Application Priority Data

Jun. 1, 1982 [DE] Fed. Rep. of Germany ..... 3220594

[51] Int. Cl.[3] ..... A24C 5/56; A24C 5/60

[52] U.S. Cl. ..... 131/281; 73/37.7

[58] Field of Search ..... 131/281, 36, 280, 60, 131/904, 905; 73/38, 37.7; 250/562, 572

[56] References Cited

U.S. PATENT DOCUMENTS

| | | | |
|---|---|---|---|
| 4,112,954 | 9/1978 | Preston et al. | 131/904 |
| 4,154,090 | 5/1979 | Heitmann et al. | 73/38 |
| 4,177,670 | 12/1979 | Heitmann et al. | 73/38 |
| 4,240,448 | 12/1980 | Heitmann et al. | 131/36 |
| 4,253,010 | 2/1981 | Brown et al. | 131/280 |
| 4,287,754 | 9/1981 | Heitmann et al. | 73/38 |
| 4,306,573 | 12/1981 | Rudszinat | 131/904 |

FOREIGN PATENT DOCUMENTS

| | | | |
|---|---|---|---|
| 2069144 | 8/1981 | United Kingdom | 131/281 |

*Primary Examiner*—V. Millin
*Assistant Examiner*—H. Macey
*Attorney, Agent, or Firm*—Peter K. Kontler

[57] ABSTRACT

A running web of cigarette paper or the like is perforated in a first portion of its path, thereupon tested for permeability by a pneumatic detector in a second portion of the path, and finally tested for permeability by an optical detector in a third portion of the path. Signals which are generated as a result of pneumatic testing are used to adjust the perforating unit in the first portion of the path. Signals which are generated as a result of testing by the optical detector are compared with a reference signal denoting the desired permeability of the web, and the web and perforating unit are arrested, or the cigarettes which contain defective portions of the web are segregated from satisfactory cigarettes, if the deviation of generated signals from the reference signal exceeds a threshold value.

12 Claims, 1 Drawing Figure

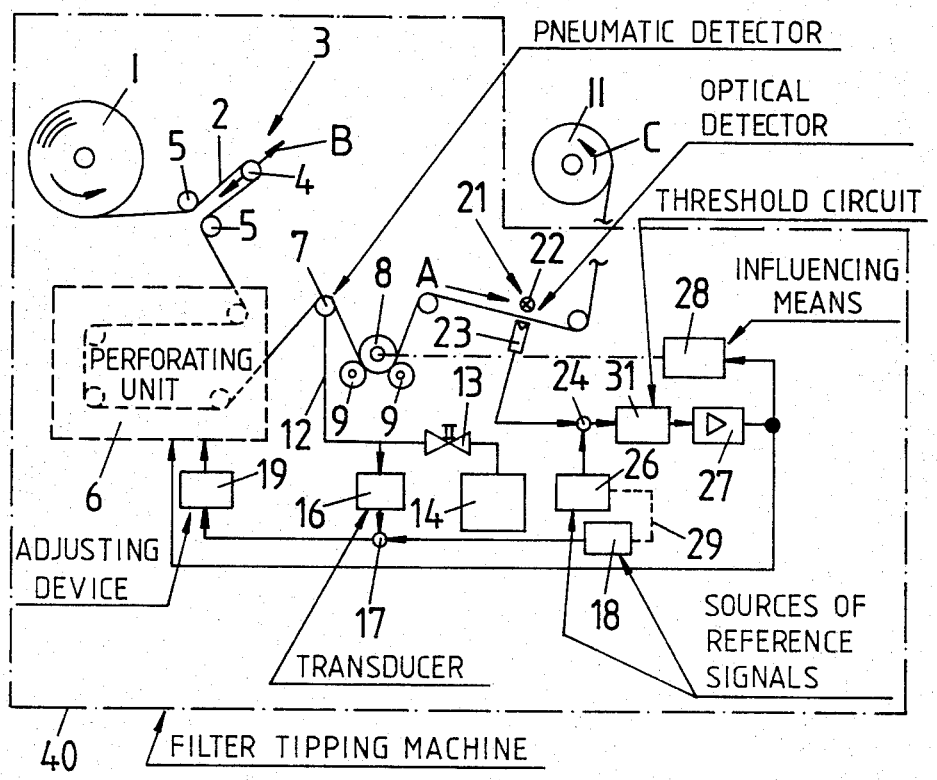
PNEUMATIC DETECTOR
OPTICAL DETECTOR
THRESHOLD CIRCUIT
INFLUENCING MEANS
PERFORATING UNIT
ADJUSTING DEVICE
TRANSDUCER
SOURCES OF REFERENCE SIGNALS
FILTER TIPPING MACHINE
I
II
2
3
4
5
6
7
8
9
12
13
14
16
17
18
19
21
22
23
24
26
27
28
29
31
40
A
B
C

APPARATUS FOR PERFORATING AND TESTING THE PERMEABILITY OF RUNNING WEBS OF CIGARETTE PAPER OR THE LIKE

BACKGROUND OF THE INVENTION

The present invention relates to the treatment of running webs which consist of paper or the like, especially to the treatment of running webs of the type used in the tobacco processing industries. Such webs include cigarette paper, imitation cork or other types of so-called tipping paper which is used in filter tipping machines to unite plain cigarettes, cigars or cigarillos of unit length or multiple unit length with filter mouthpieces of unit length or multiple unit length. More particularly, the invention relates to improvements in apparatus for perforating and testing webs of cigarette paper or the like in or outside of tobacco processing machines.

It is already known to perforate a running web of cigarette paper or the like for the purpose of providing the wrappers of plain or filter cigarettes, cigars, cigarillos, filter rod sections or other rod-shaped smokers' products with so-called ventilating zones which admit cool atmospheric air into the column of tobacco smoke. It is believed that the admission of cool atmospheric air into hot tobacco smoke exerts a beneficial influence on the effect of nicotine and condensate upon the health of the smoker. The perforating operation can be carried out at the locus of manufacturing and winding the web or directly in the processing machine, e.g., in a filter tipping machine upstream of the station where tobacco-containing rod-shaped articles are joined with filter plugs to form therewith filter cigarettes, cigars or cigarillos of unit length or multiple unit length. The web is drawn from a reel or another suitable source of supply by one or more pairs of advancing rolls which transport the web through a perforating unit, and the thus perforated web is thereupon normally transported through a pneumatic testing or monitoring device which ascertains the permeability of the perforated web and generates signals serving to adjust the perforating unit if the detected permeability deviates from an optimum value, i.e., if the articles containing portions of the monitored web would permit excessive or insufficient quantities of atmospheric air to enter the wrappers of the articles and to mix with the column of tobacco smoke. The perforated and tested web is then converted into a reel which can be shipped to a cigarette making or like plant, or the web can be immediately converted into the wrappers of rod-shaped smokers' products.

British Pat. No. 1,588,980 discloses one form of means for perforating a running web of cigarette paper or the like. The patented perforating unit employs a set of needles or analogous mechanical perforating tools which puncture selected portions of the running web. U.S. Pat. No. 2,528,158 and British Pat. No. 1,604,467 disclose electroperforating units which employ electrodes arranged to generate heat and to thus combust selected portions of the running web. A further perforating unit is disclosed in U.S. Pat. No. 4,265,254 and in British patent application No. 2,074,493 each of which proposes to use one or more sources of laser beams. Coherent radiation which is furnished by a laser is capable of making perforations of desired size with a high degree of reproducibility so that such perforating units can ensure proper ventilation of the wrappers of cigarettes or other smokers' products in which the perforated web is put to use.

The aforementioned U.S. Pat. No. 2,528,158 further discloses pneumatic testing of the web downstream of the perforating unit. As mentioned above, the results of the test can be used to adjust the perforating unit if the pneumatically ascertained permeability of the perforated web deviates from an optimum value. For example, signals which are generated by the pneumatic testing unit can be used to regulate the width and/or frequency of pulses which are employed in the patented unit to perforate the running web. The testing device is quite accurate; however, its inertia is rather pronounced so that the adjustment of the perforating unit is delayed sufficiently to permit defective portions of the web to reach the processing machine and to cause the making of unsatisfactory articles, e.g., of cigarettes whose wrappers exhibit excessive or insufficient porosity. In fact, it can happen that the processing machine receives web portions which are devoid of any perforations. This is attributable to the aforediscussed inertia of the pneumatic testing device, i.e., the device generates signals with a pronounced delay after the defective portion of the web has advanced therebeyond. This is particularly undesirable in modern high-speed machines, such as recent types of cigarette makers or filter tipping machines, which can turn out extremely large quantities of rod-shaped articles per unit of time so that even relatively short delays in detection and/or indication of detection of improperly perforated web portions can result in the making of substantial numbers of defective articles.

OBJECTS AND SUMMARY OF THE INVENTION

An object of the invention is to provide an apparatus which is capable of compensating for the defects of heretofore known apparatus and which is constructed and assembled in such a way that it can practically instantaneously detect defective portions of a perforated running web of cigarette paper, other tipping paper or the like.

Another object of the invention is to provide an apparatus wherein the manner in which the perforating unit is adjusted need not be changed at all but the apparatus is still capable of preventing unsatisfactory web portions from reaching the station where such web portions are assembled with rod-shaped articles into portions of or into finished smokers' products, or from reaching the purchaser of such products.

A further object of the invention is to provide an apparatus which can be installed in existing machines or plants as a superior substitute for heretofore known apparatus.

An additional object of the invention is to provide a machine which embodies an apparatus of the above outlined character.

Another object of the invention is to provide a novel and improved method of testing perforated webs of cigarette paper or the like and of utilizing the results of tests for influencing the progress and/or processing of defective portions of the web.

A further object of the invention is to provide an apparatus which automatically stops the perforating operation when the permeability of the web deviates from a range of acceptable permeabilities.

Still another object of the invention is to provide an apparatus which can employ any one of a wide variety of perforating units and/or any one of a wide variety of web testing or monitoring devices.

A further object of the invention is to provide an apparatus which is capable of instantaneously reacting to detection of defective wrapper portions and of initiating immediate corrective measures in response to such detection.

The invention is embodied in an apparatus for treating a running web of cigarette paper, tipping paper or the like. The apparatus comprises a set of advancing rolls or other suitable means for advancing the web in a predetermined direction and along a predetermined path, means for perforating the running web in a first portion of such path, first monitoring means for ascertaining the permeability of the perforated web in a second portion of the path downstream of the first portion, second monitoring means for ascertaining the permeability of the perforated web in a third portion of the path (e.g., downstream of the second portion) comprising means for generating first signals denoting the ascertained permeability of successive increments of the running web in the third portion of the path, a source of reference signals denoting a predetermined permeability, and means for comparing the first signals with the reference signals including means for generating third signals when one or more characteristics of the first signals deviate from the corresponding characteristic or characteristics of the reference signals.

The first monitoring means can comprise a pneumatic detector. The perforating means is preferably adjustable, and the first monitoring means can comprise means for generating fourth signals when the permeability of successive increments of the web in the second portion of the path deviates from a preselected permeability (which may but need not be identical with the aforementioned predetermined permeability), and the apparatus then preferably further comprises means for automatically adjusting the perforating means in response to the fourth signals, i.e., for changing the permeability of the running web so that the permeability which is ascertained by the first monitoring means matches the preselected permeability.

The second monitoring means can comprise a quick-reaction optical monitoring device which is designed to detect the permeability of minute successive increments of the running web in the third portion of the path and to immediately generate first signals in response to ascertainment of permeability of such minute increments of the web.

The intensity (and/or at least one other characteristic) of the third signals is preferably indicative of the extent of deviation of the first signals from the reference signals. The apparatus then preferably further comprises means for monitoring the intensity of the third signals. The means for monitoring the intensity of third signals can include means for generating additional signals when the intensity of third signals is outside of a predetermined range or, at the very least, when the intensity of third signals exceeds a predetermined threshold value. The apparatus can further comprise means for influencing (e.g., for arresting) the web advancing means in response to the generation of additional signals.

The perforating means and the monitoring means can be installed in a tobacco processing machine, e.g., in a filter tipping machine which converts the running web into the constituents of a succession of rod-shaped articles. The apparatus then preferably further comprises means for segregating from the succession of articles all articles which contain web portions whose monitoring in the third portion of the path resulted in the generation of additional signals. The segregating means can be used in lieu of the aforementioned influencing means.

The perforating means is preferably designed to provide the running web with at least one row of perforations which extend lengthwise of the web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary schematic elevational view of a portion of a tobacco processing machine combined with or incorporating a web perforating and testing apparatus which embodies the present invention.

DESCRIPTION OF THE PREFERRED EMBODIMENTS

The drawing shows schematically a tobacco processing machine 40, e.g., a filter tipping machine of the type disclosed in commonly owned U.S. Pat. No. 4,177,670. The disclosure of this patent (as well as of all other patents mentioned in the application) is incorporated herein by reference. The improved apparatus is embodied in or associated with the processing machine 40 and includes a source of web 2, e.g., a reel 1 which stores a substantial supply of convoluted web and can be rotated to pay out the web in the direction indicated by the arrow. The apparatus further comprises means for advancing the web 2 and for guiding the running web 2 in a predetermined path which extends from the reel 1 to a station where the web is converted into portions of a succession of filter cigarettes. The manner in which the conversion is effected in the machine 40 is fully described and shown in the aforementioned U.S. Pat. No. 4,177,670. The means for guiding the web includes a web tensioning device 3 including a roll 4 which is movable in the directions indicated by a double-headed arrow B to maintain the web under requisite tension. The means for guiding the web further includes several guide rolls 5. The means for advancing the web 2 along the path (in the direction which is indicated by the arrow A) comprises a driven roller 8 and two spring-biased idler rollers 9 and 9' (the springs are not shown) which urge the web 2 against the driven roller 8. If the web 2 is not immediately converted or consumed in the machine 40, it can be convoluted onto a takeup reel 11 which is ready for storage or for transport into a cigarette making, filter tipping or other web processing machine. If a reel 11 is used, it is driven to rotate in the direction of arrow C as long as the advancing means 8, 9, 9' is in motion to transport the web 2 along its path.

The apparatus further comprises a perforating unit 6 which is disposed in a first portion of the path for the web 2 and through which the web is caused to advance in a manner as indicated schematically by broken lines. The exact details of the perforating unit 6 form no part of the present invention; all that counts is that the unit 6 be adjustable because the illustrated apparatus preferably embodies an automatic adjusting feature for the perforating unit. As already mentioned above, the perforating unit 6 may be of the type disclosed in British Pat. No. 1,588,980 (which employs needles or other suitable mechanical perforating tools). Alternatively the unit 6 may constitute an electroperforating unit of the type disclosed in U.S. Pat. No. 2,528,158 or in British Pat. No. 1,604,467. Also, the unit 6 may be of the type disclosed in U.S. Pat. No. 4,265,254 or in British patent application No. 2,074,493 each of which describes and shows a perforating unit employing one or more lasers or analogous sources of coherent radiation. These are but a few examples of perforating units which can be utilized in the apparatus of the present invention.

The apparatus further comprises a first monitoring device having a pneumatic detector 7 which ascertains the permeability of successive increments of the running web 2 in a second portion of the aforementioned path which is located downstream of the first portion (perforating unit 6) and is designed to either blow or draw a stream of air across successive increments of the web 2 upstream of the web advancing means including the parts 8, 9, 9'. The construction of the detector 7 may be identical with or similar to that of the pneumatic detector which is disclosed in the aforementioned U.S. Pat. No. 2,528,158.

The detector 7 is connected with a device 14 which can constitute a source of compressed testing fluid (normally air) or a suction generating means, depending upon whether the detector is to draw or blow air across the respective portion of the path for the web 2. The connection between the detector 7 and the device 14 includes a conduit 12 which contains an adjustable flow regulating valve 13. An electropneumatic transducer 16 of any known design receives pneumatic signals from the conduit 12 and its output transmits corresponding electric signals to a signal comparing stage 17 wherein signals denoting the permeability of the web 2 (as ascertained by the detector 7) are compared with a reference signal furnished by a source 18 and denoting the desired permeability of the perforated web. The output of the stage 17 transmits a signal to an adjusting device 19 for the perforating unit 6 when the intensity and/or another characteristic of the signal which is transmitted by the transducer 16 deviates from the corresponding characteristic of the reference signal furnished by the source 18. The adjustment is such that the dimensions and/or numbers of the holes per unit area of the running web 2 are changed when the output of the stage 17 transmits a signal denoting that the permeability of the web 2 (as ascertained by the pneumatic monitoring means including the detector 7) deviates from that which is denoted by the reference signal from the source 18. If the perforating unit 6 includes one or more lasers or constitutes an electroperforating unit, the adjustment which is effected by the means 19 involves a change in the width and/or frequency of pulses which are utilized in the unit 6 to effect the making of holes in the running web. If the unit 6 utilizes needles or the like, the permeability of the running web 2 can be changed by varying the extent of penetration of the normally conical needles into the material of the web.

The pneumatic monitoring means which includes the detector 7 operates quite satisfactorily, except that its reaction to changes in porosity of the running web is not as swift as is desirable and necessary in modern high-speed cigarette makers or tippers which turn out well in excess of one-hundred rod-shaped articles per second.

In order to further enhance the reliability of the web testing operating, the improved apparatus comprises second monitoring means including an optical detector 21 having a light source 22 at one side and a signal-generating photoelectronic transducer 23 at the other side of the path for the running web 2. That portion of the path for the web 2 which is flanked by the constituents 22, 23 of the detector 21 is located downstream of the detector 7, as considered in the direction of arrow A; however, the detector 21 can also be positioned adjacent to any other portion of the path for the web 2 downstream of the perforating unit 6. Successive increments of the web 2 run between the constituents 22, 23 of the detector 21, and the transducer 23 generates signals which are indicative of the permeability of successive minute increments of the running web. Such signals are transmitted to one input of a signal comparing stage 24 another input of which receives reference signals from a source 26. The output of the stage 24 transmits signals to the input of a threshold circuit 31 which can be said to constitute a means for monitoring the intensity of signals generated by the stage 24, the intensity of such signals being indicative of the differences between the signals which are generated by the transducer 23 and reference signals furnished by the source 26. The intensity of signals at the output of the transducer 23 is indicative of the permeability of successive minute increments of the running web 2, and the intensity of signals at the output of the stage 24 is indicative of the extent to which the monitored permeability of the web 2 deviates from the desired or optimum permeability (denoted by the reference signal which is furnished by the source 26).

The output of the threshold circuit 31 is connected with the input of an amplifier 27 which transmits amplified signals to a device 28 serving to influence (particularly arrest) the advancing means 8, 9, 9' when the intensity of signals transmitted by the stage 24 to the threshold circuit 31 exceeds the selected threshold value. The influencing means 28 can constitute a motor or a transmission which drives the roller 8 and is arrested as soon as its circuit receives a signal from the amplifier 27.

The purpose of the threshold circuit 31 is to prevent minor fluctuations of the intensity of signal at the output of the signal comparing stage 24 from generating defect signals (to the amplifier 27) which would initiate stoppage of the advancing means 8, 9, 9'. In other words, the threshold value of the intensity of signals which induce the circuit 31 to transmit a signal to the amplifier 27 can be readily selected in such a way that the permeability of the web 2 can fluctuate within a certain range without initiating stoppage of the web. However, if the perforating unit 6 is brought to a halt (i.e., if the unit 6 ceases to make perforations in the web 2) and/or if the permeability of the web 2 which advances past the detector 21 deviates appreciably from the permeability which is selected by the setting of the preferably adjustable source 26 of reference signals, the amplifier 27 transmits a signal which entails immediate stoppage of the roller 8 and preferably also immediate stoppage of the perforating unit 6. For example, the transducer 23 of the detector 21 will generate an appropriate signal when the web 2 breaks, and such signal will invariably and immediately cause the amplifier 27 to effect abrupt stoppage of the web 2 and of the perforating unit 6.

The threshold circuit 31 can constitute, or be replaced with, a circuit which transmits signals to the amplifier 27 whenever the intensity of the signal at the output of the signal comparing stage is outside (above or below) a predetermined range of intensities. The reaction of the optical monitoring means including the detector 21 is instantaneous so that the advancing means 8, 9, 9' and the perforating unit 6 can be arrested practically without any delay to thus ensure that the length of that portion of the web which advances beyond the detector 21 and whose permeability deviates from an optimum permeability is minimal or nil. In other words, defective operation of the perforating unit 6 is detected without delay and it cannot entail the making of a substantial number of defective rod-shaped articles because the reaction of the second monitoring means is swift, i.e., the advancing means 8, 9, 9' is arrested immediately, the same as the perforating unit 6.

The broken line 29 denotes in the drawing an operative connection between the source 18 of reference signals for the signal comparing stage 17 and the source 26 of reference signals for the signal comparing stage 24. Such coupling of the sources 18 and 26 is often desirable in order to avoid unnecessary adjustments of the source 26 following an adjustment of the source 18, or vice versa. In other words, once the source 18 is adjusted to transmit a reference signal of predetermined intensity to the stage 17, the source 26 is also adjusted in automatic response to adjustment of the source 18 to furnish an appropriate reference signal to the stage 24. The threshold values which are selected for the circuit 31 are preferably such that the pneumatic monitoring means including the detector 7 can regulate the operation of the perforating unit 6 without any interference on the part of the optical monitoring means including the detector 21 as long as the maximum or minimum values which are selected by the setting of the circuit 31 are not exceeded.

The drawing shows that the apparatus is installed in or associated with a tobacco processing machine (40). However, and as already pointed out above, the apparatus can also be installed in the plant which makes the web 2 and the apparatus is then disposed between the source 1 of web and the takeup reel 11 which latter stores the perforated web for transport to the locale of use or into a warehouse. The manner in which a perforating unit can be installed in a tobacco processing machine, especially in a filter tipping machine, is disclosed, for example, in U.S. Pat. No. 4,240,448. Reference may be had to FIGS. 1 and 2 of this patent. As shown in the patent the freshly perforated web is immediately converted into wrappers or portions of wrappers of successive rod-shaped articles. The signal at the output of the amplifier 27 can be used to segregate from satisfactory articles all those articles which contain defective portions of the web. In other words, the influencing means 28 which is shown in the drawing can be replaced with a pneumatic or otherwise operated ejector for defective rod-shaped articles. An ejector which can be used to effect segregation of defective articles from satisfactory articles in response to defect signals is also disclosed and shown at 102, 202, and 302 in the aforementioned U.S. Pat. No. 4,177,670.

An important advantage of the improved apparatus is that the first monitoring means is capable of effecting appropriate adjustments of the perforating unit 6 with a very high degree of accuracy, and that the second monitoring means prevents the transport of improperly perforated portions of the running web beyond the second monitoring station in spite of the inertia of the first monitoring means. The two monitoring means complement each other to ensure (a) that the adjustments of the perforating unit (via adjusting means 19) lead to the making of perforations exactly as selected by the setting of the source 18 of reference signals, and (b) that the number of rejects as a result of the transport of improperly perforated portions of the web beyond the second monitoring station is negligible. The threshold circuit 31 ensures that the second monitoring means cannot interfere with the operation of the highly accurate but relatively slow first monitoring means. The accuracy of the first monitoring means including the detector 7 normally exceeds the accuracy of the second monitoring means including the detector 21. In other words, the second monitoring means provides a certain amount of leeway for operation of the first monitoring means by not reacting to each and every deviation of the characteristics of a signal at the output of the transducer 23 from the corresponding characteristics of the reference signal which is furnished by the source 26.

As a rule, one of the factors which will induce the second monitoring means to immediately stop the advancing means 8, 9, 9' is complete stoppage or deactivation of the perforating unit 6, i.e., the failure of the unit 6 to provide the web 2 with any perforations while the web advances through that portion of its path which extends through or past the perforating unit. Another factor which will cause the second monitoring means to immediately arrest the advancing means 8, 9, 9' as well as the perforating unit 6 is a breakage of the web 2. This is detected by the transducer 23 as an abrupt increase in porosity of the web.

The utilization of the improved apparatus is particularly important and highly advantageous in the plant where the web 2 is formed, i.e., for testing of permeability before the freshly perforated web is stored on a takeup reel 11 or the like. This will be readily appreciated because prolonged failure or partial malfunctioning of the perforating apparatus in such a machine would result in storage of substantial lengths of unperforated or improperly perforated web on the reel 11 with the result that the material on the reel would be used up for the making of a large number of defective articles. It is evident that rapid detection of improper operation or stoppage of the perforating unit and/or of breakage of the web is also important in a filter tipping machine. However, a filter tipping machine is normally equipped with means for testing the wrappers of finished products so that such wrapper testing means can detect whether or not the permeability of wrappers of successively tested articles meets the prescribed standards. In either event (i.e., in a machine which makes the web and in a machine which processes the web to convert it into portions of rod-shaped smokers' products or the like), the improved apparatus reduces the number of rejects to a minimum by immediately and automatically undertaking the necessary measures when the ascertained permeability deviates from the desired permeability.

In a filter tipping machine, the web of tipping paper is normally stored in the form of a reel from which the web is drawn past a so-called curling device, thereupon along a paster which coats one side of the web with a suitable adhesive, and then into the range of a severing device which subdivides the leader of the web into a series of uniting bands which are applied to successive groups of coaxial rod-shaped articles including one or more plain cigars, cigarillos or cigarettes and one or more filter rod sections. The uniting bands are thereupon convoluted around the respective groups to connect the filter rod sections with the neighboring tobacco-containing commodities. The improved apparatus can be installed anywhere between the just discussed reel and the severing device.

It has been found that the improved apparatus greatly enhances the uniformity of aerating zones in long series of plain or filter cigarettes, cigars, cigarillos, filter rod sections or analogous products. The apparatus is relatively simple and compact, and it can employ the reliable pneumatic monitoring means for adjustment of the perforating unit. The rapidly reacting second monitoring means can be designed for more drastic influencing of the operation of the improved apparatus, such as total and abrupt stoppage of the perforating unit 6 and/or abrupt stoppage of the advancing means 8, 9, 9'.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for treating a running web of cigarette paper, tipping paper or the like, comprising means for advancing the web in a predetermined direction along a predetermined path; adjustable means for perforating the running web in a first portion of said path; first monitoring means for ascertaining the permeability of the perforated web in a second portion of said path, comprising means for generating first signals when the permeability of successive increments of the running web in said second portion of said path deviates from a preselected permeability; means for adjusting said perforating means in response to said first signals; second monitoring means for ascertaining the permeability of the perforated web in a third portion of said path, comprising means for generating second signals denoting the ascertained permeability of successive increments of the running web in said third portion of said path; a source of third signals denoting a predetermined permeability; and means for comparing said second signals with said third signals, including means for generating fourth signals when said second signals deviate from said third signals.

2. The apparatus of claim 1, wherein said first monitoring means comprises a pneumatic detector.

3. The apparatus of claim 1, wherein said second portion of said path is located between said first and third portions, as considered in said direction.

4. The apparatus of claim 1, wherein said second monitoring means includes an optical monitoring device arranged to detect the permeability of minute successive increments of the running web in said third portion of said path and to generate said second signals in immediate response to monitoring of the respective increments.

5. The apparatus of claim 1, wherein the intensity of said fourth signals is indicative of the extent of deviation of said second signals from said third signals, and further comprising means for monitoring the intensity of said fourth signals.

6. The apparatus of claim 5, wherein said means for monitoring the intensity of said fourth signals includes means for generating fifth signals when the intensity of fourth signals is outside of a predetermined range of intensities.

7. The apparatus of claim 5, wherein said means for monitoring the intensity of said fourth signals includes means for generating fifth signals when the intensity of said fourth signals exceeds a predetermined theshold value.

8. The apparatus of claim 7, further comprising means for influencing said advancing means in response to said fifth signals.

9. The apparatus of claim 8, wherein said influencing means comprises means for arresting said advancing means.

10. The apparatus of claim 7, wherein said perforating means is installed in a tobacco processing machine.

11. The apparatus of claim 10, wherein said processing machine is arranged to convert the running web into constituents of a succession of rod-shaped articles, and further comprising means for segregating from said succession all articles containing web portions whose monitoring in said third portion of said path resulted in the generation of said fifth signals.

12. The apparatus of claim 1, wherein said perforating means comprises means for providing the running web with at least one row of perforations extending lengthwise of the web.

* * * * *